United States Patent [19]

Bokelman et al.

[11] 4,347,859

[45] Sep. 7, 1982

[54] ACID CURING OF TOBACCO

[75] Inventors: Gordon H. Bokelman, Boulder, Colo.; Dewitt T. Gooden, III, Barnwell, S.C.

[73] Assignee: Philip Morris Incorporated, New York, N.Y.

[21] Appl. No.: 214,494

[22] Filed: Dec. 9, 1980

[51] Int. Cl.[3] ..... A24B 3/12; A24B 15/30; A24B 15/42

[52] U.S. Cl. ..... 131/290; 131/307; 131/309; 131/310

[58] Field of Search ..... 131/307, 309, 310, 290

[56] References Cited

U.S. PATENT DOCUMENTS

| | | | |
|---|---|---|---|
| 787,611 | 4/1905 | Daniels, Jr. | 131/309 |
| 891,001 | 6/1908 | Parant et al. | 131/309 |
| 953,214 | 3/1910 | Mahone | 131/307 |
| 1,113,902 | 10/1914 | Lawrence et al. | 131/309 |
| 1,543,245 | 6/1925 | Buensod | 131/309 |
| 1,545,811 | 7/1925 | Buensod | 131/309 |
| 1,568,316 | 1/1926 | Buensod | 131/309 |
| 2,164,030 | 6/1939 | Coe | 131/309 |
| 2,343,345 | 3/1944 | Touton | 131/309 |
| 2,914,072 | 11/1959 | Tyrer et al. | 131/310 |
| 3,086,533 | 4/1963 | Touton | 131/309 |
| 3,225,456 | 12/1965 | Touton | 131/309 |
| 3,845,774 | 11/1974 | Tso et al. | 131/140 C |

FOREIGN PATENT DOCUMENTS

| | | | |
|---|---|---|---|
| 1517240 | 3/1970 | Fed. Rep. of Germany | 131/309 |
| 47-8998 | 3/1972 | Japan | 131/309 |

*Primary Examiner*—V. Millin

*Attorney, Agent, or Firm*—Arthur I. Palmer, Jr.; George E. Inskeep

[57] ABSTRACT

A process for artificially curing mature green tobacco is provided wherein the tobacco is immersed in an acidic medium and incubated therein at at least room temperature until the desired color develops. Incubation at pH 1.5 to 3.5 at about 50° C. for as little as 3 hours may be sufficient to eliminate the green color and green smoke taste and odor of the tobacco.

6 Claims, No Drawings

ACID CURING OF TOBACCO

BACKGROUND OF THE INVENTION (a) Field of the Invention

This invention relates to a method for artifically curing green tobacco by means of acid incubation.

(b) State of the Art

Green tobacco leaf curing and/or aging by suspending the leaves in darkness or otherwise disposing the leaves while controlling temperature and relative humidity of circulating air currents is disclosed in U.S. Pat. Nos. 1,113,902, 1,543,245, 1,545,811, 1,568,316, 2,343,345 and 3,086,553. Forced air flow through bundles of green leaves has also been suggested as a means to cure green tobacco in U.S. Pat. No. 3,225,456. Such conventional methods of curing tobacco, characteristically require several days and may entail substantial expenditures for fuel. Further such curing processes tend to be labor intensive.

In U.S. Pat. No. 3,845,774 curing is effected by homogenizing yellowed tobacco leaf, incubating the homogenized material and then curing the mass as it is dried. The leaf characteristics may be manipulated during this homogenization curing method by chemical, physical or biological means; for example, ascorbic acid is added to the homogenate in Example 9.

However, none of these prior art methods effect curing by means of acids. Further, in contrast to the majority of prior art curing methods, the present acid curing method provides means for eliminating the green color and green odor and taste of tobacco which is rapid and less labor and energy intensive.

SUMMARY OF THE INVENTION

In accordance with the invention mature green tobacco is cured rapidly and economically by immersing the tobacco in an aqueous acid solution and incubating the immersed tobacco until the green color of the tobacco is eliminated.

DETAILED DESCRIPTION OF THE INVENTION

The present invention provides a means for removing the green color and taste of tobacco. This artificial curing method comprises immersing tobacco in an aqueous solution having a pH in the acid range and incubating the immersed tobacco for a period of time sufficient to produce the desired color.

The process of the invention has application to mature green tobacco including burley and bright tobaccos. When treated according to the invention, the tobacco may be in fresh untreated form or may have been pressed to express juices therefrom and thereby reduce the content of alkaloids, nitrogen, reducing sugars or the like in the tobacco material. The pressed tobacco may optionally be allowed to dry prior to treatment according to the invention. Further the tobacco to be treated may be whole leaf or in pieces.

The medium employed to incubate the tobacco has a pH in the acid range in order to permit relatively rapid curing. Aqueous acid solutions have been found to work satisfactorily. Specifically aqueous solutions of acetic, ortho-phosphoric, hydrochloric, lactic, formic and 2-chloroethyl phosphonic acids are effective media for purposes of the present invention.

The pH of the incubation medium will affect the rate of curing. Media having a pH between about 1.5 and 3.5 are particularly preferred since at these low pH's rapid curing is possible. The most effective pH will depend on the type of tobacco and its maturity.

The temperature of the incubation likewise affects the rate of curing. Thus although curing can be effected at room temperature, slightly elevated temperatures of about 50° C. are preferred in order to expedite the curing process.

By employing reduced pH's and temperatures of about 50° C., curing to acceptable colors is possible in as little as 3 hours. Generally curing effected in the preferred pH range and at temperatures between room temperature and about 50° C. will require no more than a few days.

Incubation is effected by simply completely immersing lossely packed tobacco in the aqueous acid medium under the above conditions for a period of time sufficient to produce the desired color. Incubation may be effected in sealed containers to avoid pH changes due to evaporation. However, the incubation can be effected in the presence or absence of oxygen.

During the incubation stage the tobacco loses its objectionable green color. The color after treatment varies from greenish-brown to yellow to brown. This color change or yellowing effected by the process removes the green smoke taste and odor from the tobacco.

The incubation process of the invention provides flexibility in controlling the chemistry of tobacco. The soluble components of the tobacco including alkaloids, reducing sugars, potassium and the like are largely removed during acid incubation curing. If desired the incubation media may be processed to selectively remove particular constituents. The processed media can then be applied to cured tobacco to reintroduce desirable constituents therein followed by drying of the resultant product.

When the tobacco solubles in the acid medium reach a concentration of about 15% the tobacco no longer loses any solubles. Therefore, if the acid incubation is carried out in a solution that contains such an amount of tobacco solubles, loss of tobacco solubles during curing can be minimized.

After the acid curing the tobacco may be placed on a perforated conveyor or screen to drain, and then if desired may be rinsed with water and dried. Optionally, the extracted tobacco solubles may be concentrated and reapplied to the tobacco prior to drying.

A tobacco leaf treated in accordance with the curing process of the invention has a form and color similar to conventional flue-cured tobacco, but if the leaf has previously been pressed, stemming is not required.

The following examples are illustrative of the invention:

EXAMPLE 1

Coker 319 bright tobacco, mature upper stalk, harvested one week earlier and stored at −20° C., was treated in three forms: unpressed, pressed, and pressed and dried. The pressed tobacco was obtained by twice passing the tobacco leaves between felt pads through a Noble and Wood Press at 650 pounds per linear inch. A sample of the pressed tobacco was dried at ambient conditions for 24 hours to yield tobacco having 13% OV.

Aqueous acids were adjusted to pH 3.5 as follows: 20 ml of distilled water plus one drop of glacial acetic acid;

80 ml of water plus one drop of concentrated phosphoric acid; 30 ml of distilled water plus one drop of formic acid. Leaf sections measuring $\frac{3}{8}$ by $\frac{3}{8}$ inch were immersed in the solutions in stoppered vials and held at ambient temperature in a dark place to avoid and differentiate from photobleaching effects. Observations after 3 and 5 days are tabulated in Table 1.

TABLE 1

| Mature Green Bright Leaf--Room Temperature Incubation | | | |
|---|---|---|---|
| | | Appearance | |
| Liquid | Sample | 3 Days | 5 Days |
| Distilled Water | Unpressed | yellowish green | greenish yellow |
| | Pressed | light green | yellowish green |
| | Pressed, dried | light green | yellowish green |
| Acetic Acid | Unpressed | very light greenish yellow | brownish yellow |
| | Pressed | slight greenish yellow | brownish yellow |
| | Pressed, dried | light greenish yellow | slight greenish yellow |
| Phosphoric Acid | Unpressed | yellow | yellow |
| | Pressed | slight greenish yellow | slight greenish yellow |
| | Pressed, dried | slight greenish yellow | slight greenish yellow |
| Formic Acid | Unpressed | brownish yellow | brownish yellow |
| | Pressed | slight greenish yellow | slight greenish/brown yellow |
| | Pressed, dried | light greenish yellow | greenish yellow |

EXAMPLE 2

Samples of Coker 319 bright tobacco, harvested one week earlier and stored at −20° C., were placed in two 2-gallon jars and immersed in aqueous acetic acid at pH 3.5. One jar was placed in an oven maintained at 50° C., the other in a closed cabinet at room temperature. After six hours, samples at 50° C. were entirely bright yellow, those unheated were only very slightly yellow.

EXAMPLE 3

Burley leaf, Ky 14, mature but not yellow, harvested three days earlier and stored at −20° C., was cut into $\frac{3}{8}\times\frac{3}{8}$-inch sections. Pressed samples were produced as described in Example 1. Samples were immersed in 20 ml of the treating solutions as indicated in Table 2 in vials. The vials were then heated to 50° C. and sealed, wrapped in aluminum foil, and maintained at that temperature. Observations at the specified intervals are recorded in Table 2.

TABLE II

| Mature Burley Green Leaf--Incubation at 50° C. | | | | |
|---|---|---|---|---|
| | | Appearance | | |
| Treating Solution | Sample | 1 Day | 2½ Days | 4 Days |
| 2 drops 2-chloroethyl-phosphonic acid | Pressed | slight brownish yellow | light brownish yellow | very light yellow brown |
| | Unpressed | brownish yellow | brownish yellow | yellowish brown |
| Acetic acid, pH 3.5 | Pressed | slight brownish yellow | light brownish yellow | very light yellow brown |
| | Unpressed | brownish yellow | brownish yellow | yellowish brown |
| | Pressed, dried | slight brownish yellow | light yellowish brown | — |
| Distilled Water | Pressed | light green | light brownish yellow-green | pale greenish yellow |
| | Unpressed | brownish yellow | brownish yellow-green | light greenish brown |
| | Pressed, dried | light greenish yellow | light greenish brown | — |
| 4 Drops lactic acid | Pressed | slight brownish yellow | light brownish yellow | very light yellow brown |
| | Unpressed | brownish yellow | brownish yellow | yellowish brown |
| Sodium chloride, 5% (brine) | Pressed | green | light greenish yellow | light greenish yellow |
| | Unpressed | brownish green | greenish brown | greenish brown |

The results indicate that acid incubation is much more effective than neutral (water or brine) treatment.

EXAMPLE 4

Small samples of mature green bright tobacco, Coker 319, stored in a cool room for two weeks after harvesting, were placed in vials as in Example 1 and covered with water adjusted to a range of pH levels as follows: for pH less than 7, addition of phosphoric acid; for pH greater than 7, addition of concentrated aqueous KOH; and for pH 7.0, addition of potassium phosphate (monobasic)/sodium hydroxide as buffer. The vials were stoppered and wrapped in foil, placed in constant temperature bath at 50° C., and opened at intervals for observation. Table 3 gives the color changes noted in the leaf sections.

TABLE 3

Mature Green Bright Leaf - Incubation at 50° C.

Color Code:
1. green; 2. light green;
3. yellowish green; 4. greenish yellow;
5. yellow; 5.5 light brownish yellow;
6. brownish yellow; 7. yellowish brown;
8. light brown; 8.5 brownish green;
9. light greenish brown; 10. greenish brown;
11. brown.

| | | Color Rating | | | | |
|---|---|---|---|---|---|---|
| | Treatment | 4½ hours | 1 Day | 2 Days | 3 Days | 4 Days |
| Unpressed | pH 1.5 | 5 | 5 | 5 | 5 | 5 |
| | 2.5 | 2 | 6 | 6 | 8 | 8 |
| | 3.5 | 1 | 4 | 4 | 6 | 7 |
| | 4.5 | 1 | 4 | 4 | 6 | 7 |
| | 5.5 | 1 | 4 | 4 | 6 | 6 |
| | 7.0 | 1 | 3 | 3 | 6 | 7 |
| | 8.5 | 1 | 3 | 4 | 6 | 6 |
| | 9.5 | 1 | 3 | 4 | 6 | 6 |
| | 10.5 | 1 | 3 | 4 | 6 | 6 |
| | 11.5 | 1 | 1 | 2* | 2 | 2 |
| | 12.5 | 1 | 1 | 1* | 1 | 1 |
| | Tap $H_2O$ | 1 | 3 | 9 | 9 | 9 |
| Pressed | pH 1.5 | 6 | 7 | 7 | 11 | 11 |
| | 2.5 | 3 | 7 | 11 | 9 | 8 |
| | 3.5 | 1 | 4 | 8.5 | 9 | 8 |
| | 4.5 | 1 | 3 | 8.5 | 9 | 8 |
| | 5.5 | 1 | 3 | 8.5 | 9 | 8 |

TABLE 3-continued

Mature Green Bright Leaf - Incubation at 50° C.

Color Code:
1. green; 2. light green;
3. yellowish green; 4. greenish yellow;
5. yellow; 5.5 light brownish yellow;
6. brownish yellow; 7. yellowish brown;
8. light brown; 8.5 brownish green;
9. light greenish brown; 10. greenish brown;
11. brown.

| Treat-ment | Color Rating | | | | |
|---|---|---|---|---|---|
| | 4½ hours | 1 Day | 2 Days | 3 Days | 4 Days |
| 7.0 | 1 | 2 | 2 | 2 | 9 |
| 8.5 | 1 | 2 | 3 | 3 | 9 |
| 9.5 | 1 | 2 | 8.5 | 3.5 | 8 |
| 10.5 | 1 | 2 | 3 | 3 | 9 |
| 11.5 | 1 | 1 | 1* | 2 | 2 |
| 12.5 | 1 | 1 | 1* | 1 | 1 |
| Tap $H_2O$ | 1 | 1 | 1 | 8.5 | 8.5 |

*Solution had light green color.

As the greenish tinges are least desirable, the results indicate that acceptable coloration (codes 5 through 8 or 11) is rapidly achieved at very low pH, 1.5 to 2.5.

Longer exposures may produce similar results at higher pHs.

What is claimed is:

1. A process for curing green tobacco comprising immersing the tobacco in an aqueous solution of an acid selected from the group consisting of acetic, phosphoric, hydrochloric, lactic, formic and 2-chloroethylphosphonic acids and incubating the immersed tobacco at at least room temperature.

2. The process of claim 1 wherein the incubation is effected at a pH between 1.5 and 3.5.

3. The process of claim 1 wherein the incubation is effected at about 50° C.

4. The process of claim 1 wherein the incubation is effected at a pH of 1.5 to 3.5 and a temperature of about 50° C. for at least three hours.

5. The process of claim 1 wherein mature green tobacco is cured.

6. A process for curing mature green tobacco comprising pressing the tobacco to express fluids therefrom, then immersing the tobacco in an aqueous solution of an acid selected from the group consisting of acetic, phosphoric, hydrochloric, lactic, formic and 2-chloroethylphosphonic acids and incubating the immersed tobacco at at least room temperature until said tobacco has an appearance of cured tobacco.

* * * * *